US010730656B2

(12) United States Patent
Maier

(10) Patent No.: US 10,730,656 B2
(45) Date of Patent: Aug. 4, 2020

(54) CRATE IN THE FORM OF A FLAP-ADHESIVELY-BONDED BOX COMPOSED OF CARDBOARD

(71) Applicant: Gottfried Maier, Bad Hall (AT)

(72) Inventor: Gottfried Maier, Bad Hall (AT)

( * ) Notice: Subject to any disclaimer, the term of this patent is extended or adjusted under 35 U.S.C. 154(b) by 470 days.

(21) Appl. No.: 15/509,314

(22) PCT Filed: Sep. 15, 2015

(86) PCT No.: PCT/AT2015/050231
§ 371 (c)(1),
(2) Date: Mar. 7, 2017

(87) PCT Pub. No.: WO2016/040977
PCT Pub. Date: Mar. 24, 2016

(65) Prior Publication Data

US 2017/0259952 A1 Sep. 14, 2017

(30) Foreign Application Priority Data

Sep. 16, 2014 (AT) ..... A 50647/2014
Sep. 29, 2014 (AT) ..... A 50690/2014

(51) Int. Cl.
*B65D 5/00* (2006.01)
*B65D 5/32* (2006.01)
(Continued)

(52) U.S. Cl.
CPC ..... *B65D 5/003* (2013.01); *B65D 5/001* (2013.01); *B65D 5/326* (2013.01); *B65D 5/4266* (2013.01); *B65D 5/443* (2013.01)

(58) Field of Classification Search
CPC ..... B65D 5/001; B65D 5/0015; B65D 5/003; B65D 5/0035; B65D 5/0045;
(Continued)

(56) References Cited

U.S. PATENT DOCUMENTS 2,868,430 A 1/1959 Hamilton
4,133,474 A * 1/1979 Hall ..... B65D 5/326 229/122.33
(Continued)

FOREIGN PATENT DOCUMENTS

DE 94 11 769 U1 9/1994
DE 10 2005 058289 A1 6/2007
(Continued)

OTHER PUBLICATIONS

International Search Report of PCT/AT2015/050231, dated Nov. 18, 2015.

*Primary Examiner* — Christopher R Demeree
*Assistant Examiner* — Nina K Attel
(74) *Attorney, Agent, or Firm* — Collard & Roe, P.C.

(57) ABSTRACT

A crate is described in the form of a flap-adhesively-bonded box composed of cardboard having a bottom (1) and a shell (2) protruding from the bottom (1), which forms reinforced upper longitudinal edge sections by way of edge flaps (8) folded inward between the shell corners. To provide advantageous design conditions, it is proposed that the shell (2) have, at least on one side of the shell corners, attachment flaps (10, 11, 26), which are each bent inward according to crease lines (12, 13, 27), which are outwardly offset in relation to the edge (14) of the reinforced longitudinal edge sections, by 90° and are adhesively bonded to the opposite side of the shell corner, and the bottom (1) be provided in the region of the shell corners with recesses (17) adapted to the outline shape of a catch attachment (15) formed by the attachment flaps (10, 11, 26).

12 Claims, 8 Drawing Sheets

(51) Int. Cl.
*B65D 5/42* (2006.01)
*B65D 5/44* (2006.01)

(58) Field of Classification Search
CPC .... B65D 5/4266; B65D 5/002; B65D 5/0025; B65D 5/005; B65D 5/006; B65D 5/0065; B65D 5/20; B65D 5/2004; B65D 5/2009; B65D 5/22; B65D 5/24; B65D 5/243; B65D 5/246–248; B65D 5/443; B65D 5/441; B65D 5/04; B65D 81/054; B65D 81/055; B65D 81/056; B65D 5/004
USPC ..... 229/915, 918, 919, 165, 166, 169, 170, 229/181, 182, 186–189
See application file for complete search history.

(56) References Cited

U.S. PATENT DOCUMENTS 4,151,948 A * 5/1979 de la Fuente, Jr. .. B65D 5/0025 206/512
5,052,615 A * 10/1991 Ott ..... B65B 25/04 206/509
5,427,309 A * 6/1995 Voss ..... B65D 5/4266 229/182
6,481,619 B1 11/2002 Jackson
2005/0040217 A1 2/2005 Fry

FOREIGN PATENT DOCUMENTS

DE 20 2010 009 800 U1 9/2011
FR 2 226 844 A6 11/1974
FR 2 761 340 A1 10/1998
FR 2 761 341 A1 10/1998
JP 2004 136953 A 5/2004
RU 3748 U1 3/1997
WO 03/072444 A1 9/2003

* cited by examiner

CRATE IN THE FORM OF A FLAP-ADHESIVELY-BONDED BOX COMPOSED OF CARDBOARD

CROSS REFERENCE TO RELATED APPLICATIONS

This application is the National Stage of PCT/AT2015/050231 filed on Sep. 15, 2015, which claims priority under 35 U.S.C. § 119 of Austrian Application Nos. A 50647/2014 filed on Sep. 16, 2014, and A 50690/2014 filed on Sep. 29, 2014, the disclosures of which are incorporated by reference. The international application under PCT article 21(2) was not published in English.

FIELD OF THE INVENTION

The invention relates to a crate in the form of a flap-adhesively-bonded box composed of cardboard comprising a bottom and a shell protruding from the bottom, which forms reinforced, upper longitudinal edge sections by way of edge flaps folded inward between the shell corners.

DESCRIPTION OF THE PRIOR ART

Known crates composed of cardboard are frequently manufactured from a flap-adhesively-bonded blank, wherein the circumferential walls of the shell, which protrude from a bottom, are reinforced by inwardly folded edge flaps between the shell corners in the region of the longitudinal edges opposite to the bottom. Such flap-adhesively-bonded crates in the form of boxes which are open on top have the disadvantage of a lack of stacking capability. To produce stackable crates composed of cardboard, for example, providing wall webs bent inward parallel to the bottom on two opposing circumferential walls is known (FR 2 226 844), which are fastened with the aid of fastening flaps. The inwardly bent wall webs therefore form support surfaces for crates placed thereon of equivalent construction. To prevent mutual offset of the stacked crates, the walls of the shell adjoining the circumferential walls having the angled wall webs are provided with upwardly protruding attachments, which engage in a bottom recess of the respective crate placed thereon. These upwardly protruding wall attachments have a low intrinsic strength, however, so that damage to these attachments has to be expected, whereby the stability of stacks having such damaged crates is impaired. This also applies to crates in which the upwardly protruding wall webs engaging in bottom openings of a crate placed thereon are not associated with the wall webs bent inward by 90°, but rather are formed by inwardly folded edge flaps for reinforcing the longitudinal walls (U.S. Pat. No. 6,481,619 B1) or for reinforcing the walls on the narrow side of the crate (US 2005/0040217 A1).

In addition, providing overlap flaps opposite to one another in pairs in the corner regions of cuboid crates is known (DE 20 2010 009 800 U1), which rise toward one another in pairs originating from the upper wall edges opposite to one another and, with an end section which protrudes beyond the wall edge, form a catch edge for engaging in a bottom slot of a crate placed thereon of equivalent construction. Notwithstanding the fact that stack securing is only possible opposite to the rising direction due to the overlap flaps rising in one direction at a flat angle, which requires a proper engagement in each case of two opposing overlap flaps in the bottom slots of a crate placed thereon, the end section of the overlap flaps forming the catch edge, which protrudes freely from a fastening web, cannot ensure the required stability for secure locking of the stacked crates, particularly because the weight of the respective crates placed thereon predominantly has to be dissipated via the overlap flaps onto the shell.

SUMMARY OF THE INVENTION

The invention is therefore based on the object of designing a crate composed of cardboard in such a manner that not only is a high level of intrinsic stability ensured, but rather also a stacking capability corresponding to the rough operating requirements can be ensured.

Proceeding from a carton of the type described at the outset, the invention achieves the stated object in that the shell has, at least on one side of the shell corners, attachment flaps, which are each bent inward according to outwardly offset crease lines by 90° and are adhesively bonded to the opposite side of the shell corner, and the bottom is provided in the region of the shell corners with recesses adapted to the outline shape of a catch attachment formed by the attachment flaps.

By way of the attachment flaps, which are bent inward by 90° and which connect each of the circumferential walls of the shell to one another in the upper region of the shell corners resulting between the circumferential walls and protrude upward beyond the edge of the reinforced longitudinal edge sections of the circumferential walls, protruding, stable catch attachments are provided in the region of the shell corners of the box, via which the individual crates of a stack of crates can be fixed in the mutual stacking location thereof, when these protruding catch attachments engage in a bottom recess, which is adapted to the outline shape of the catch attachments formed by the attachment flaps. The catch attachments engaging in the region of the four shell corners in the bottom recesses of a crate placed thereon therefore fix the respective crate placed thereon in a formfitting manner, wherein the dissipation of the load takes place via the circumferential walls, which are provided for this purpose with longitudinal edge sections reinforced by inwardly folded edge flaps between the protruding catch attachments.

To form the catch attachments, the shell can have, on both sides of the shell corners, attachment flaps, which are each bent inward according to outwardly offset crease lines by 90° and are adhesively bonded to one another, so that the connection of the circumferential walls meeting in the shell corners is produced via the attachment flaps, which are adhesively bonded to one another, of the opposing sides of the shell corners. To take into consideration the respective thickness of the attachment flaps in the case of the folding of the attachment flaps to be adhesively bonded to one another, the crease lines of the attachment flaps which are bent inward by 90° can each be offset in relation to one another accordingly.

To reinforce the catch attachments composed of the attachment flaps which are adhesively bonded to one another, the attachment flaps can have a square basic shape and can be folded along a diagonal, so that a doubling of the thickness of the attachment flaps adhesively bonded to one another results in the region of the attachment flaps. The attachment flaps, which are triangular after the folding, can come to rest one on top of another. However, more favorable design conditions are provided with respect to the strength if one of the two attachment flaps adhesively bonded to one another is folded around the folded other attachment flap.

The protruding catch attachments can also be formed by attachment flaps provided on only one side of the shell corners, which have an adhesive flap on the side facing toward the other side of the shell corners, so that the attachment flaps can be adhesively bonded to the opposite side of the shell corner. Although an arrangement of the adhesive flap on the inner side of the shell corner is fundamentally possible, better strength conditions result if the adhesive flap of the attachment flaps overlaps the outer side of the shell corner, because then the attachment flaps can additionally be supported on an edge section of the adjoining circumferential wall of the shell.

To ensure full support of the stacked crates on the reinforced longitudinal edge sections of the respective lower crate, the shell can be recessed in the region of the bottom recesses in a depth corresponding to the protrusion of the catch attachments formed by the attachment flaps above the edge of the reinforced longitudinal edge sections. This means that as a result of the shell recesses in the region of the bottom recesses, the loads do not have to be dissipated via the shell corners and therefore the attachment flaps can engage sufficiently deep into the bottom recesses of the respective crates placed thereon to achieve secure anchoring of the individual crates in a stack of crates.

To obtain an advantageous load dissipation to the respective lower crate, the reinforced longitudinal edge sections of the shell can form bottom-parallel support surfaces for the respective crate placed thereon. These support surfaces result due to the inward folding of the edge flaps between the protruding corner sections via two parallel crease lines, so that the edge flaps between the corner sections are initially bent backward by 90° around one and then the other crease line toward the shell and are adhesively bonded to the shell.

During the automatic setup and adhesive bonding of crates according to the invention, difficulties result in the forming of the bottom-parallel support surfaces, because the edge flaps region of the support surfaces do not rest on the shell walls. In order that these difficulties can be avoided, the inwardly folded edge flaps can have a further crease line between the two crease lines for forming a support surface, which further crease line enables a planar contact of the bent-over flap also in the region of the support surface, which is folded about this additional crease line. The support surface is first folded apart about the additional crease line, to accommodate the crate placed thereon, in the event of a load of this folded support surface when a crate is placed thereon.

Simple design conditions in the embodiment of the support surfaces also result if the two crease lines for forming a bottom-parallel support surface are arranged at a distance from one another corresponding to twice the thickness of the edge flaps and have a double flap thickness due to an edge section folded inward toward the shell. In this case, the reinforced longitudinal edge section comprises three cardboard layers formed by corresponding folds, which is accompanied by an increased strength for the crates.

The typically printed circumferential walls of the crates represent the costlier part of a cardboard blank. To obtain a cost-effective crate, it is therefore advantageous to form the shell as a blank which is separate from the bottom. These separate shell blanks enable better utilization of the cardboard sheets required for the shell blank, wherein the bottom blank can be cut to size from a less expensive cardboard. In the sense of restricting the cardboard for the shell blank to the shall regions absolutely required for this purpose it is additionally advantageous for the bottom to be provided with adhesive flaps extending up to the edge flaps of the reinforced longitudinal edge sections of the shell blank, so that the circumferential walls of the shell are additionally reinforced by the adhesive flaps of the bottom blank, which can have the result under certain circumstances that the thickness of the cardboard used for the shell blank can be reduced.

BRIEF DESCRIPTION OF THE DRAWING

The subject matter of the invention is illustrated by way of example in the drawing. In the figures.

DESCRIPTION OF THE PREFERRED EMBODIMENT

Figure 1:
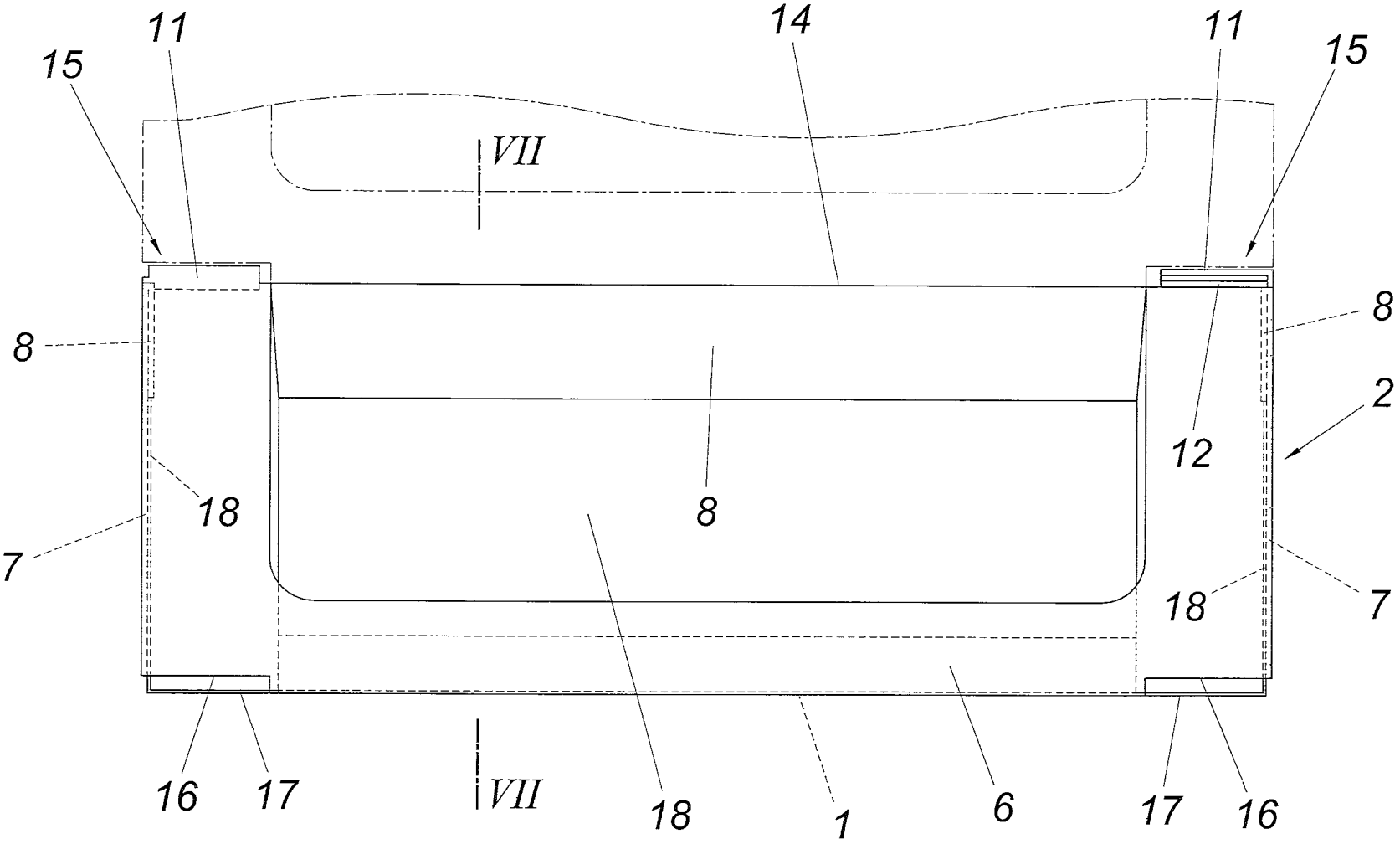
FIG. 1 shows a crate according to the invention composed of cardboard in a schematic side view.
Figure 2:
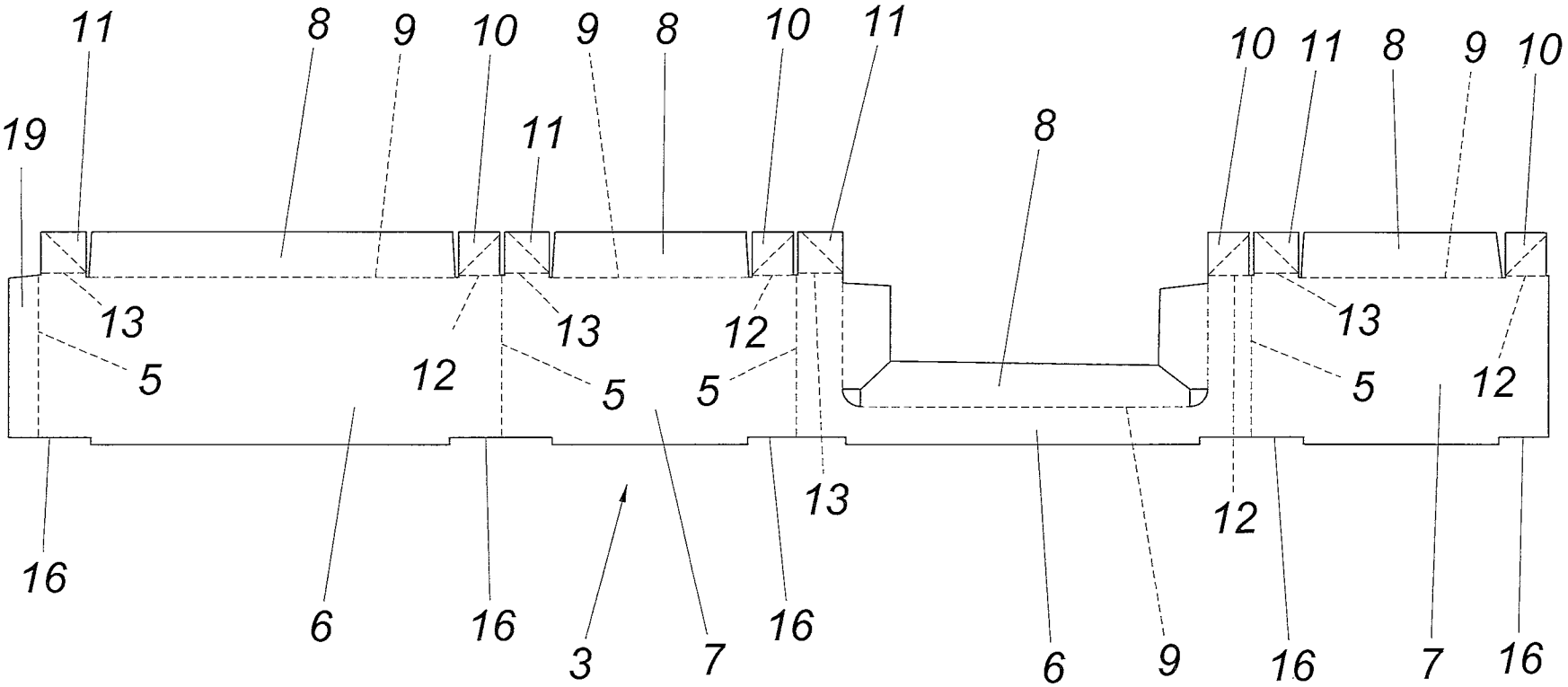
FIG. 2 shows the shell blank for a crate according to FIG. 1 in a smaller scale.
Figure 3:
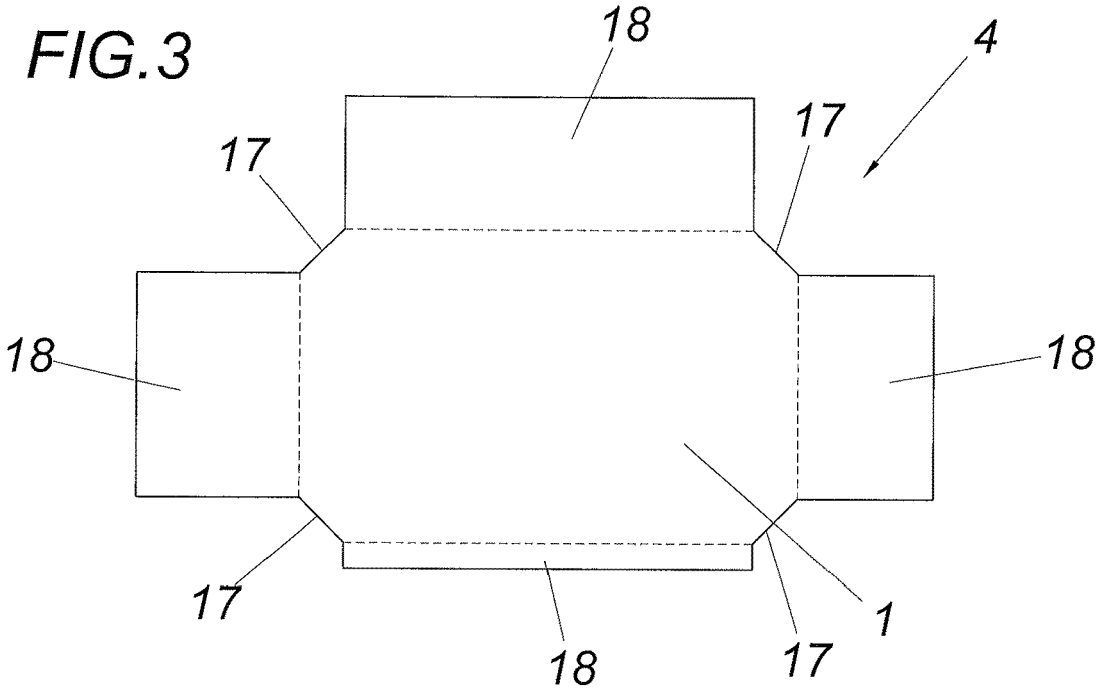
FIG. 3 shows a bottom blank for a crate according to FIG. 1.

The crate according to the exemplary embodiment according to FIGS. 1 to 3 is formed by a flap-adhesively-bonded box composed of cardboard, which, in its basic shape, has a rectangular bottom 1 and a shell 2 protruding from the bottom. The bottom 1 and the shell 2 are formed by separate blanks, wherein the shell blank 3 and the bottom blank 4 are preferably manufactured from different cardboard materials. The shell blank 3 could thus consist of a corrugated cardboard and the bottom blank 4 could be manufactured from a solid cardboard, which is not in any way required, however.

As can be inferred from FIG. 2, the shell blank 3 has four circumferential walls 6 and 7, which are separated from one another by crease lines 5 and are opposite to one another in pairs in the finished carton. The circumferential walls 6 and 7 are provided with edge flaps 8 between the shell corners, which are defined by the crease lines 5, the edge flaps being folded inward about folding lines 9 to form reinforced upper longitudinal edge sections.

Figure 5:
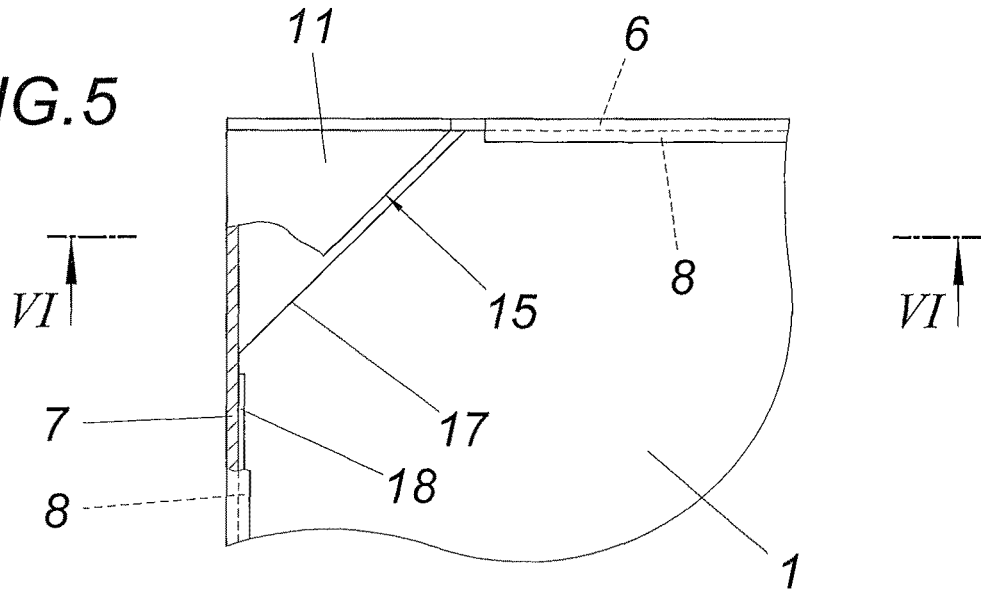
FIG. 5 shows a partially cutaway top view of a corner of a crate according to the invention in a larger scale.
Figure 6:
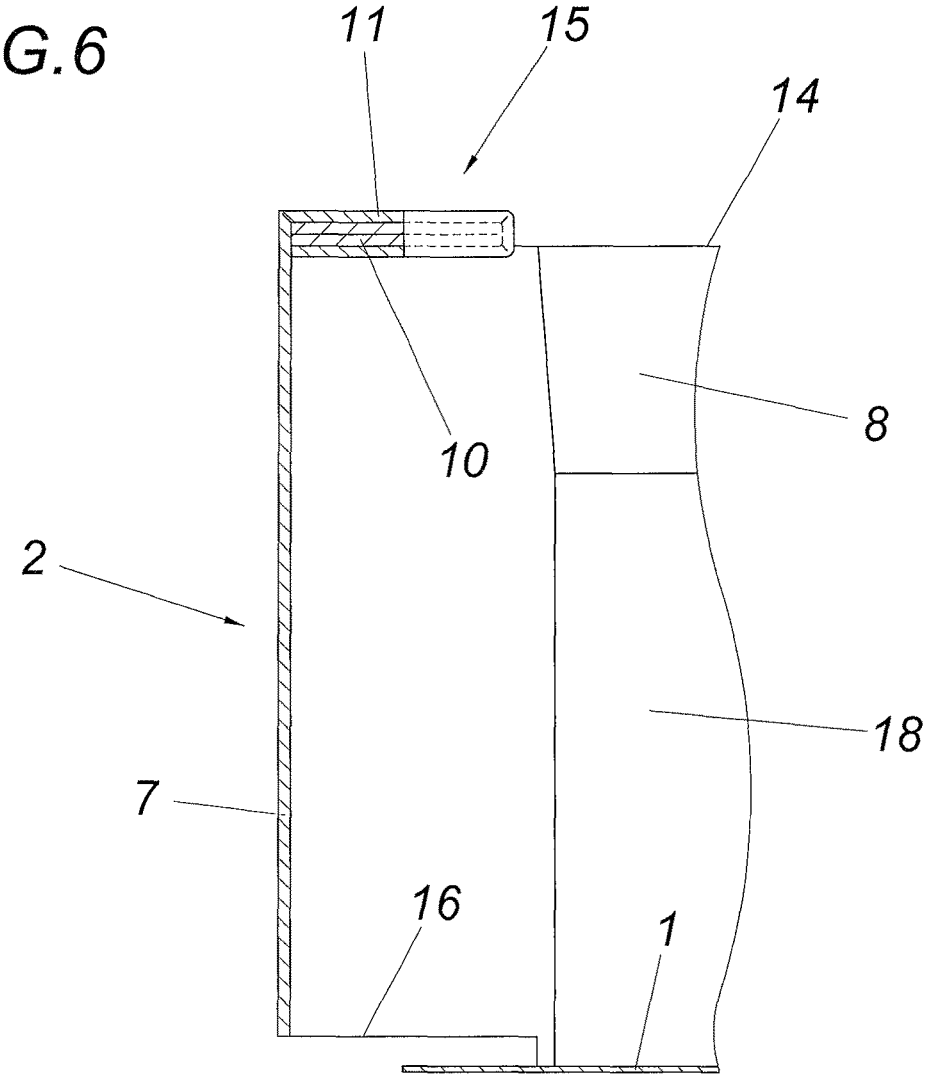
FIG. 6 shows a section along line VI-VI in FIG. 5.

On both sides of the shell corners, the shell blank 3 forms attachment flaps 10, 11, which, to manufacture the crate, are bent in by 90° about crease lines 12, 13 and adhesively bonded to one another, to form in each case a catch attachment 15 protruding beyond the edge 14 formed by the inwardly folded edge flaps 8, as can be inferred in particular from FIGS. 1 and 6. For this purpose, the crease lines 12 and 13 of the attachment flaps 10 and 11 are offset in relation to the edge 14 defined by the crease lines 9 and in relation to one another. To reinforce these catch attachments 15, the attachment flaps 10 and 11, which essentially have a square basic shape, can be folded along a diagonal, so that a triangular catch attachment 15 results in the top view according to FIG. 5. On the opposing bottom side of the shell corners, the circumferential walls 6 and 7 are recessed corresponding to the protrusion of the catch attachments 15 resulting due to the attachment flaps 10, 11, which are adhesively bonded to one another. These recesses are identified with 16.

The associated bottom blank 4 has, in the regions of the shell corners, recesses 17, adapted to the outline shape of the attachment flaps 10, 11, which are adhesively bonded to one another, adhesive flaps 18 being provided between these recesses. The width of these adhesive flaps 18 is selected so that in the finished crate, they extend up to the edge flaps 8 of the reinforced longitudinal edge sections of the shell blank 3, so that the circumferential walls 6 and 7 of the crate are formed double-walled over the entire height in the loadbearing region.

To manufacture a crate from the shell blank 3 and the bottom blank 4, the shell is folded about the crease lines 5 and closed with the aid of an adhesive flap 19 on the circumference around the bottom 1, which is adhesively bonded with the aid of its adhesive flaps 18 on the inner side of the circumferential walls 6 and 7. In the region of the shell corners, the attachment flaps 10 are folded about the diagonals thereof with adhesive bonding and bent inward about the crease lines 12 by 90°, before the attachment flaps 11 provided on the opposite side of the respective shell corner are bent in about the crease line 13 thereof and bent along a diagonal about the folded attachment flaps 10, as can be inferred in particular from FIG. 6, In the corner regions, the catch attachments 15 protruding above the edge 14 of the circumferential walls 6 and 7 are thus formed, which engage in a formfitting manner in the recesses 17 of the bottom 1 when a structurally equivalent crate is placed thereon. The recesses 16 in the bottom region of the circumferential walls release the space required for this purpose. It is therefore shown that a formfitting anchoring of the individual crates in a stack of crates is achieved by the catch attachments 15 engaging in the bottom recesses 17. The dissipation of the loads onto the respective lower crates takes place via the circumferential walls 6 and 7, on the upper edge 14 of which each of the upper crates is supported, as indicated by dot-dash lines in FIG. 1.

Figure 7:
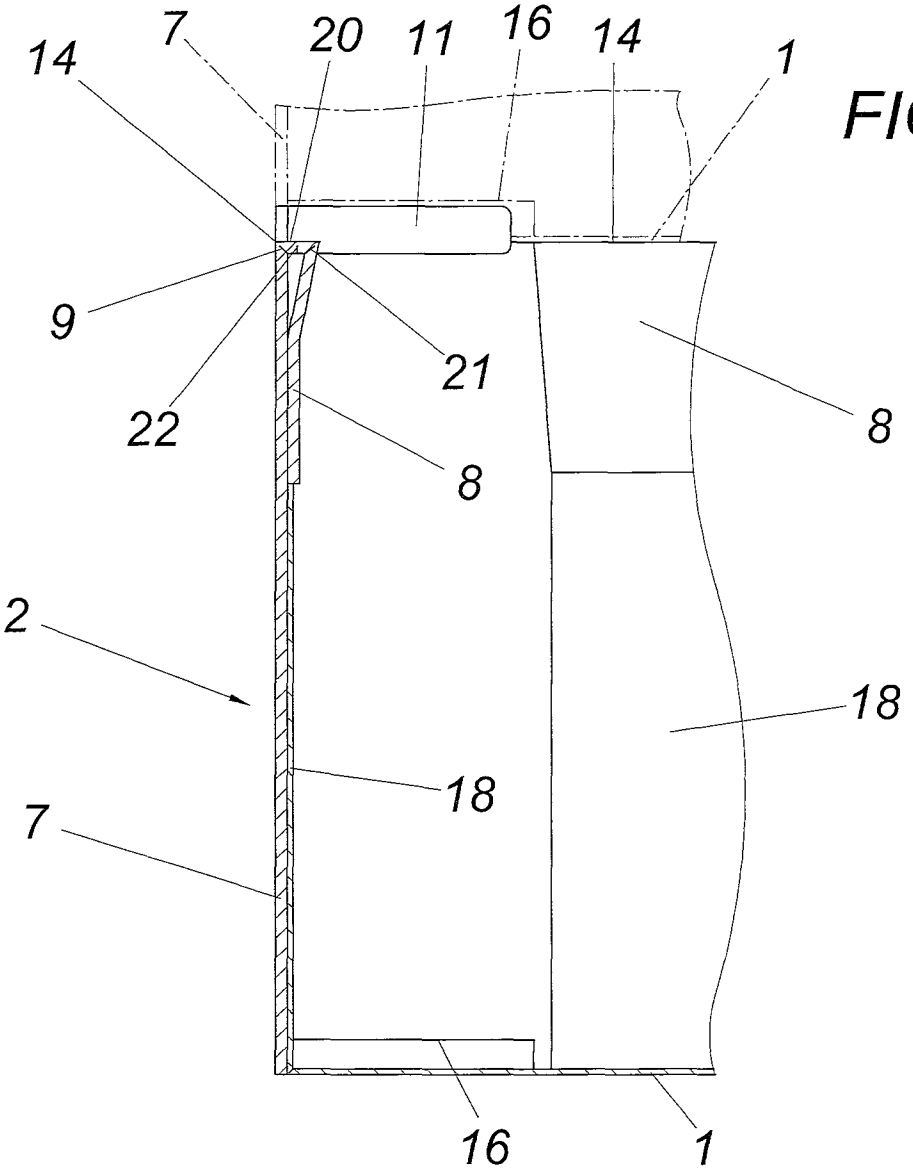
FIG. 7 shows a section through a design variant corresponding to line VII-VII of FIG. 1 in an enlarged scale.
Figure 9:
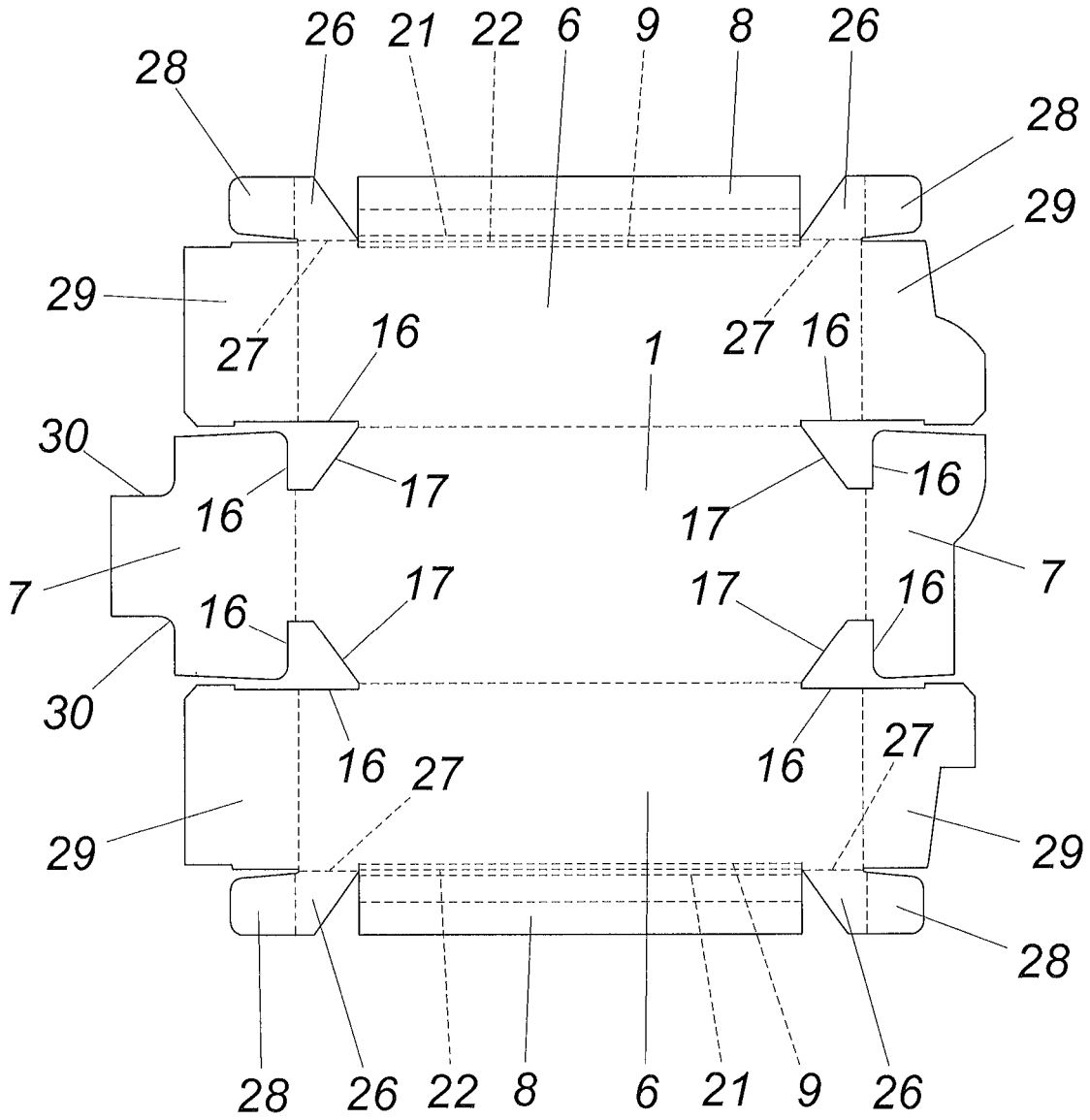
FIG. 9 shows the blank for a further design variant of a crate according to the invention.
Figure 10:
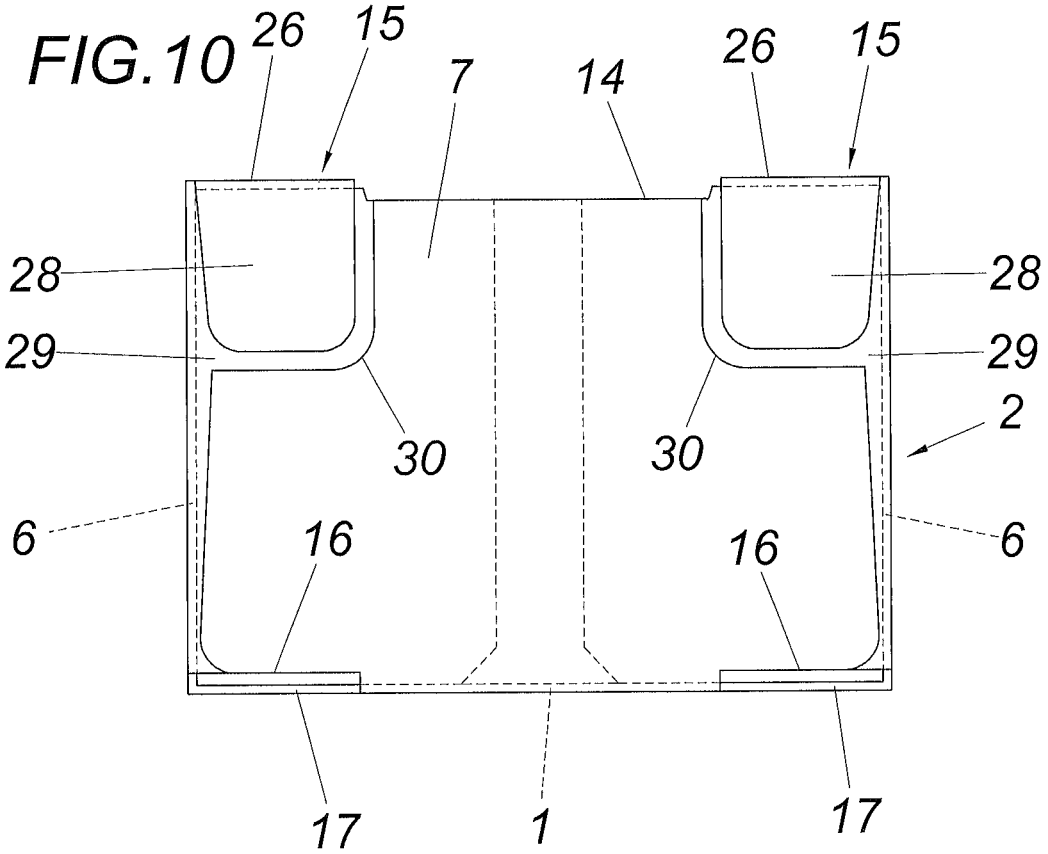
FIG. 10 shows a frontal view of a crate according to the blank according to FIG. 9 in an enlarged scale.
Figure 11:
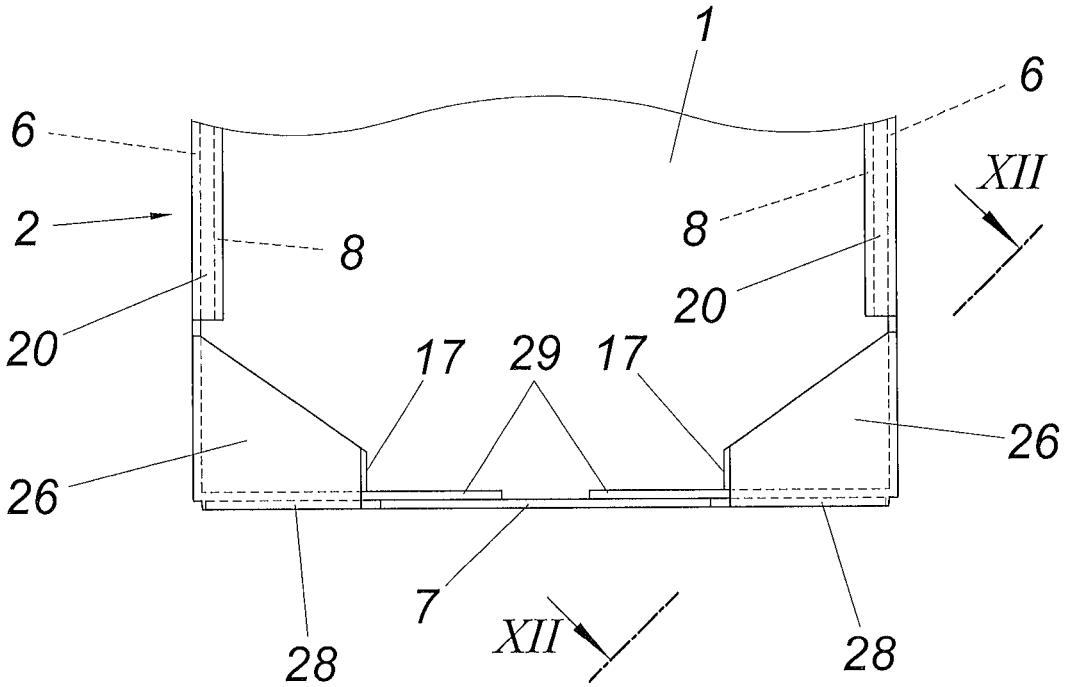
FIG. 11 shows the crate according to FIG. 10 in a top view in the region of a circumferential wall.

As a result of the upper longitudinal edge sections reinforced by the inwardly folded edge flaps 8, higher loads can also be absorbed and dissipated without risk via the circumferential walls 6 and 7 of the crates. To ensure a secure support of the respective upper crates on the lower crates, even if the circumferential walls 6, 7 are bent out by the accommodated contents, the inwardly folded edge flaps 8 can form a widened support surface 20 according to FIG. 7, in that the edge flaps 8 are folded via two crease lines 9 and 21, so that a web forming the edge 14 results as a support surface 20 for the crates between these two crease lines 9 and 21. Such a crate placed thereon is indicated by dot-dash lines in FIG. 7.

It can be seen that the circumferential wall 7 with the adjoining bottom 1 is supported on the support surface 20 of the edge web, while the catch attachment 15 can engage unobstructed in the bottom recess 17 as a result of the clearance achieved by the shell recess 16.

For automatic folding and adhesive bonding of the edge flaps 8, it is advantageous if the support surface 20 is folded so that the edge flap 8 is also applied over its entire area to the respective circumferential wall 6, 7 in the region of the support surface 20. This is achieved when the support surface 20 is folded about an additional crease line 22 so that the two sections of the support surface 20, which are separated from one another by the additional crease line 22, are applied between the crease line 9 and one another. In this case, the support surface 20 is first folded apart about the crease line 9 into the bottom-parallel working position in the event of a corresponding load.

Figure 8:
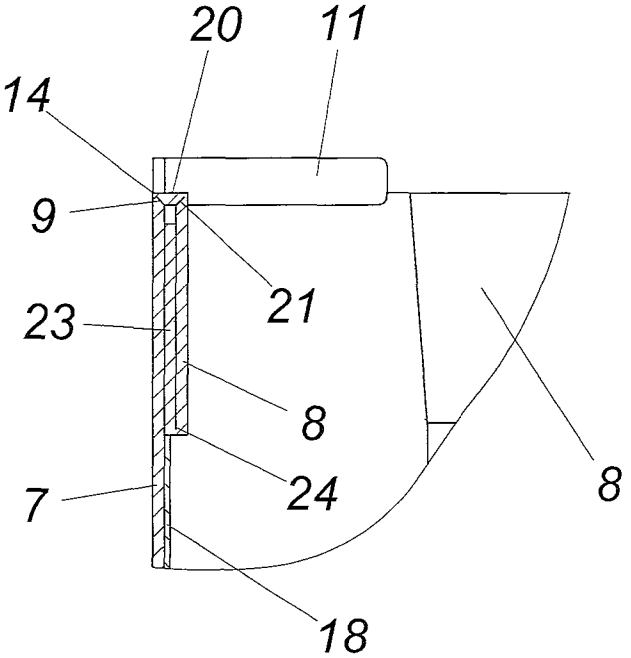
FIG. 8 shows a further design variant for a reinforced longitudinal edge section in an illustration corresponding to FIG. 7.

To achieve good support of the support surface 20, according to FIG. 8, the two crease lines 9 and 21, between which the support surface 20 results, can also have a minimum distance from one another corresponding to twice the thickness of the edge flaps 8, so that an edge section 23, which extends the edge flaps 8, can be folded inward about a folding line 24, to obtain a triple cardboard layer in the region of the reinforced longitudinal edge section.

Figure 4:
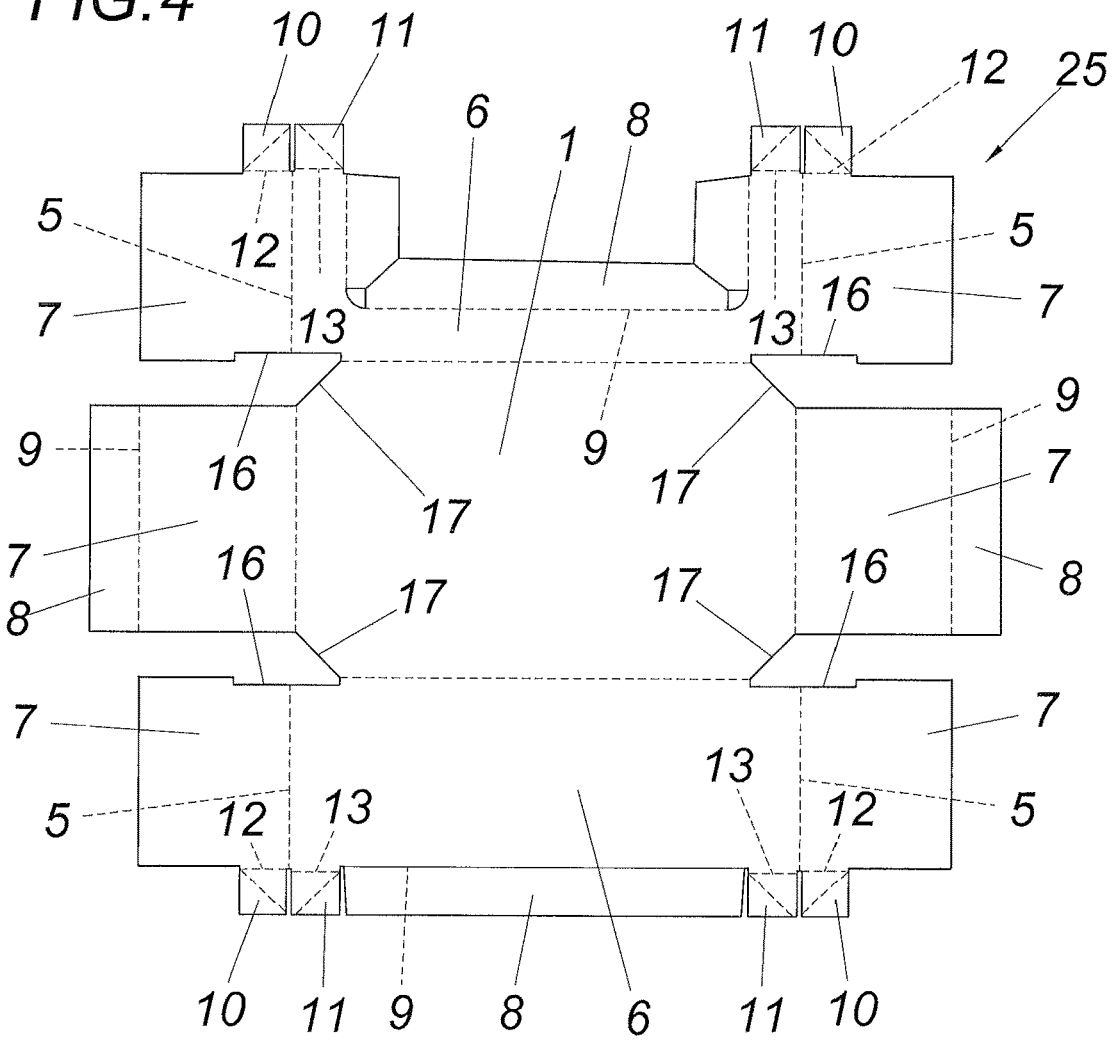
FIG. 4 shows a blank which jointly forms the bottom and the shell of a crate according to the invention.

Although the production of a crate according to the invention from blanks 3, 4 which are separate from one another for the shell 2 and the bottom 1 is accompanied by manufacturing advantages, the invention is not restricted to such an embodiment, of course. The crate could also be manufactured from a blank 25 shown in FIG. 4, which forms both the bottom 1 and also the circumferential walls 6 and 7. The formation of the catch attachments 15 from the attachment flaps 10, 11, which are opposing via the shell corners, and which are bent inward about crease lines 12, 13 by 90° and adhesively bonded to one another, remains the same, so that the formfitting latching of the crates stacked one on top of another with the aid of the catch attachments 15 engaging in the corresponding bottom recesses 17 is advantageously utilized.

Figure 12:
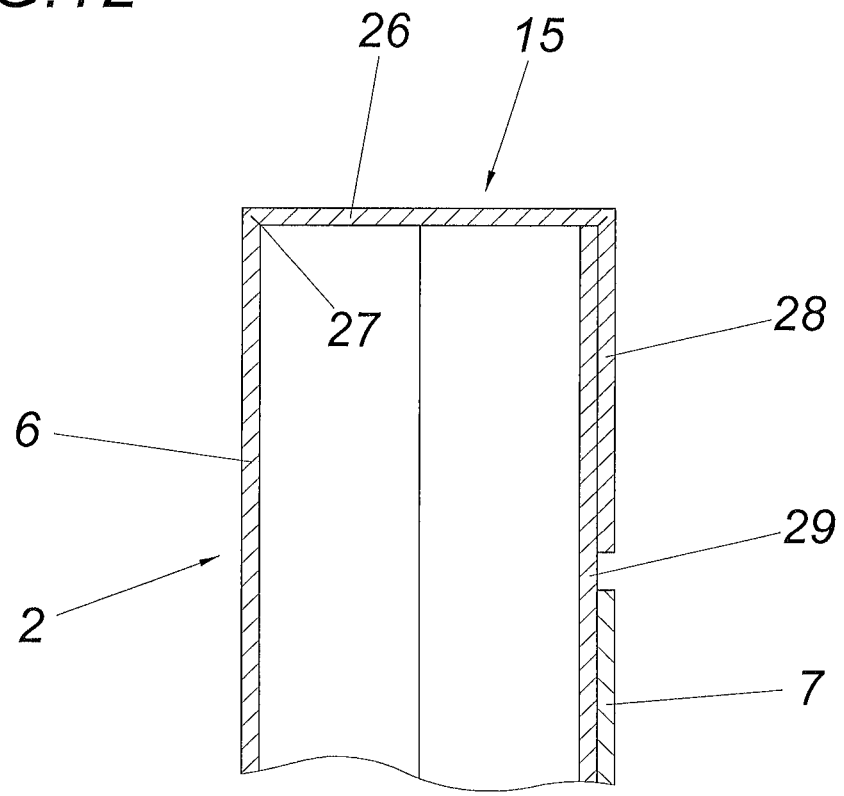
FIG. 12 shows a section along line XII-XII of FIG. 11 in an enlarged scale.

According to the exemplary embodiment according to FIGS. 8 to 11, the catch attachments 15 are formed by attachment flaps 26 of the circumferential walls 6, which are provided only on one side of the shell corners. The attachment flaps 26, which are bent inward about a crease line 27 by 90°, are provided with adhesive flaps 28 in the region facing toward the opposite side of the shell corners. When the box is set up, the circumferential walls 7 overlap the inwardly bent connection flaps 29 of the circumferential walls 6. The arrangement is made in this case so that the circumferential walls 7 have recesses 30 at least on an end face of the box in the region of the adhesive flaps 28, so that the adhesive flaps 28 can be adhesively bonded on the outer side of the connection flaps 29 and do not protrude in relation to the circumferential walls 7, as can be inferred from FIGS. 10 to 12. The connection flaps 29 therefore form a part of the circumferential walls 7. Using the attachment flaps 26, which are formed on one of the two circumferential walls 6, 7, which meet in a shell corner, and are connected via the adhesive flap 28 to the other circumferential wall 7, catch attachments 15 protruding beyond the edge 14 of the circumferential walls 6, 7 are therefore again formed, which engage in a formfitting manner in corresponding recesses 17 in the bottom 1 of structurally equivalent crates placed thereon.

The invention claimed is:

1. A crate in the form of a flap-adhesively-bonded box composed of cardboard comprising:

a bottom and a shell rising from the bottom and comprising four circumferential walls provided with edge flaps, shell corners, and at least on one side of the shell corners attachment flaps, wherein the shell forms reinforced upper longitudinal edge sections by way of the edge flaps folded inwardly between the shell corners in order to dissipate load via the four circumferential walls, wherein the attachment flaps protrude beyond an edge of the reinforced upper longitudinal edge sections and are each bent inwardly about crease lines by 90°, wherein the crease lines are outwardly offset in height in relation to the edge of the reinforced upper longitudinal edge sections, and wherein the bottom is provided in a region of the shell corners with recesses adapted to an outline shape of catch attachments formed by the attachment flaps and the shell is recessed in a region of the recesses at a depth corresponding to a protrusion of the catch attachments beyond the edge of the reinforced upper longitudinal edge sections.

2. The crate according to claim 1, wherein the shell has, on both sides of the shell corners, the attachment flaps, which are bent inwardly by 90° about the crease lines which are each offset outward in relation to the edge of the reinforced upper longitudinal edge sections, and are adhesively bonded to one another.

3. The crate according to claim 2, wherein the crease lines of the attachment flaps, which are bent inwardly by 90°, are each offset in relation to one another.

4. The crate according to claim 2, wherein the attachment flaps, which have a square basic shape, are folded along a diagonal.

5. The crate according to claim 4, wherein the attachment flaps on both sides of the shell corners which are bent inwardly by 90° and are adhesively bonded to one another are further folded together along the diagonal such that one of the attachment flaps forms an inner folded attachment flap and the other attachment flap forms an outer folded attachment flap that folds around the inner folded attachment flap.

6. The crate according to claim 1, wherein the attachment flaps provided on one side of the shell corners have an adhesive flap on a side of the attachment flaps facing toward the opposite side of the respective shell corners.

7. The crate according to claim 6, wherein the adhesive flap of the attachment flaps overlaps an outer side of the opposite side of the shell corner.

8. The crate according to claim 1, wherein the reinforced upper longitudinal edge sections formed by the inwardly folded edge flaps are bent back toward the shell about two crease lines while forming a bottom-parallel support surface.

9. The crate according to claim 8, wherein the inwardly folded edge flaps between the two crease lines for forming the support surface have an additional crease line.

10. The crate according to claim 8, wherein the two crease lines for forming the bottom-parallel support surface are arranged at a distance from one another corresponding to twice a thickness of the edge flaps such that edge sections of the edge flap are folded inwardly toward the shell to form a double flap thickness.

11. The crate according to claim 1, wherein the shell forms a blank separate from the bottom.

12. The crate according to claim 11, wherein the bottom has adhesive flaps extending up to the edge flaps of the reinforced upper longitudinal edge sections of the shell blank.

* * * * *